US006827031B2

(12) United States Patent
Aoyama

(10) Patent No.: US 6,827,031 B2
(45) Date of Patent: Dec. 7, 2004

(54) STEERING SYSTEM FOR WATERCRAFT

(75) Inventor: Yusuke Aoyama, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/280,199

(22) Filed: Oct. 24, 2002

(65) Prior Publication Data

US 2003/0075094 A1 Apr. 24, 2003

(30) Foreign Application Priority Data

Oct. 24, 2001 (JP) ..... 2001-326849

(51) Int. Cl.[7] ..... B63H 25/44
(52) U.S. Cl. ..... 114/145 R; 114/284
(58) Field of Search ..... 114/55.5, 55.52, 114/55.54, 55.55, 123, 126, 144 R, 144 RE, 145 A, 145 R, 284, 285, 286, 287

(56) References Cited

U.S. PATENT DOCUMENTS 3,802,369 A * 4/1974 Ishimoto ..... 114/282
3,982,493 A * 9/1976 Cronin ..... 114/144 R
4,556,005 A 12/1985 Jackson
4,949,662 A 8/1990 Kobayashi
4,972,792 A 11/1990 Yokoyama et al.
5,094,182 A 3/1992 Simner
5,113,777 A 5/1992 Kobayashi
5,209,438 A * 5/1993 Wygnanski ..... 244/203
5,249,992 A * 10/1993 Schneider ..... 440/50
5,697,317 A 12/1997 Pereira
5,713,297 A 2/1998 Tani et al.
5,813,357 A * 9/1998 Watson ..... 114/145 R
5,908,006 A 6/1999 Ibata
6,000,355 A * 12/1999 Hall ..... 114/123
6,032,605 A 3/2000 Takashima
6,038,995 A 3/2000 Karafiath et al.
6,138,601 A 10/2000 Anderson et al.
6,178,907 B1 1/2001 Shirah et al.
6,216,624 B1 4/2001 Page
6,305,307 B1 10/2001 Yokoya
6,415,729 B1 * 7/2002 Nedderman et al. ..... 114/162
6,508,187 B2 * 1/2003 Maeda et al. ..... 114/55.57
2001/0027739 A1 10/2001 Simard et al.
2002/0028613 A1 3/2002 Matsuda et al.
2002/0077009 A1 6/2002 Swartz et al.

FOREIGN PATENT DOCUMENTS

CA 2271332 2/2000

OTHER PUBLICATIONS

U.S. application No. 10/080,371; filed Feb. 15, 2002; Inventor: T. Yanagihara.
U.S. application No. 09/813,465; filed Mar. 19, 2001; Inventors: K. Iida, et al.
U.S. application No. 09/813,438; filed Mar. 19, 2001; Inventors: S. Koyano, et al.
"Jet Sports," Aug., 1996, pp. 5, 76, and 77.
"Jet Sports," Aug., 1997, pp. 4, 46, 51, and 57.
"Personal Water Craft Illustrated," Aug., 1998, pp. 3, 8, and 81.

* cited by examiner

*Primary Examiner*—Andrew Wright
(74) *Attorney, Agent, or Firm*—Knobbe, Martens, Olson & Bear, LLP

(57) ABSTRACT

A watercraft includes moveable sponsons that are moved in response to movements of the handlebars and the accelerator lever. The watercraft can include a number of different kinds of actuators for moving these sponsons relative to the hull of the watercraft. In preferred embodiments, the sponsons are moved outwardly and/or downwardly relative to the hull.

6 Claims, 13 Drawing Sheets

STEERING SYSTEM FOR WATERCRAFT

PRIORITY INFORMATION

This invention is based on any claims priority to Japanese Patent Application No. 2001-326849, filed Oct. 24, 2001, the entire contents of which is hereby expressly incorporated by reference.

BACKGROUND OF THE INVENTION

1. Field of the Invention

This application is directed to steering systems for watercraft, and in particular, steering systems using movable sponsons.

2. Description of the Related Art

Personal watercraft have become very popular in recent years. This type of watercraft is quite sporting nature and carries one or more riders. A hull of the personal watercraft commonly defines the rider's area above an engine compartment. An internal combustion engine powers a jet propulsion unit that propels the watercraft by discharging the water rearwardly. The engine lies within the engine compartment in front of a tunnel, which is formed on an underside of the hull. The jet propulsion unit is placed within the tunnel and includes an impeller that is driven by the engine.

A deflector or steering nozzle is mounted on a rear end of the jet propulsion unit for steering the watercraft. A steering mast with a handlebar is linked with the deflector through a linkage. The steering mast extends upwardly in front of the rider's area. A rider can remotely steer the watercraft using the handlebar.

The engine typically includes at least one throttle valve disposed in an air intake passage of the engine. The throttle valve regulates the amount of air supplied to the engine. Typically, as the amount of air increases, the engine output also increases. A throttle lever or control is attached to the handlebar and is linked with the throttle valves usually through a throttle linkage and a cable. The rider thus can control the throttle valve remotely by operating the throttle lever on the handlebar.

SUMMARY OF THE INVENTION

In accordance with one aspect of the present invention, a watercraft comprises a hull, an engine supported by the hull, and a power request input device positioned for operation by an operator of the watercraft. A steering input device is mounted to the hull and configured for pivotal movement between port and starboard directions. The watercraft also includes port and starboard side sponsons, and a controller configured to move the port and starboard sponsons relative to the hull between a retracted position and a deployed position. The controller is configured to deploy the port side sponson when the steering input device is turned toward the port side.

In accordance with one aspect of the present invention, a watercraft comprises a hull, an engine supported by the hull and having an output shaft, and a propulsion device connected to the output shaft of the engine. A steering input device is configured to be manually operable by an operator. A steering device is configured to steer the watercraft in accordance with the position of the steering input device. The watercraft also includes a sponson module. The sponson module comprises a sponson body having a first inner surface facing toward a side of the hull, a second lower surface extending from the inner surface away from the hull, and a third surface extending at an angle from the second surface and being spaced outwardly from the first inner surface. The sponson module also includes a guide mechanism defining a fixed path of travel for the sponson body between a first retracted position and a second deployed position. A steering sensor is configured to detect a position of the steering input device and to generate a position signal indicative of the position of the steering input device. An actuator is configured for moving the sponson body between the first and second positions, and a controller is configured to control the actuator based on the position signal from the steering sensor.

BRIEF DESCRIPTION OF THE DRAWINGS

These and other features, aspects and advantages of the present invention will now be described with reference to the drawings of preferred embodiments, which are intended to illustrate and not to limit the invention. The drawings comprise the following figures.

DETAILED DESCRIPTION OF THE PREFERRED EMBODIMENT

Figure 1:
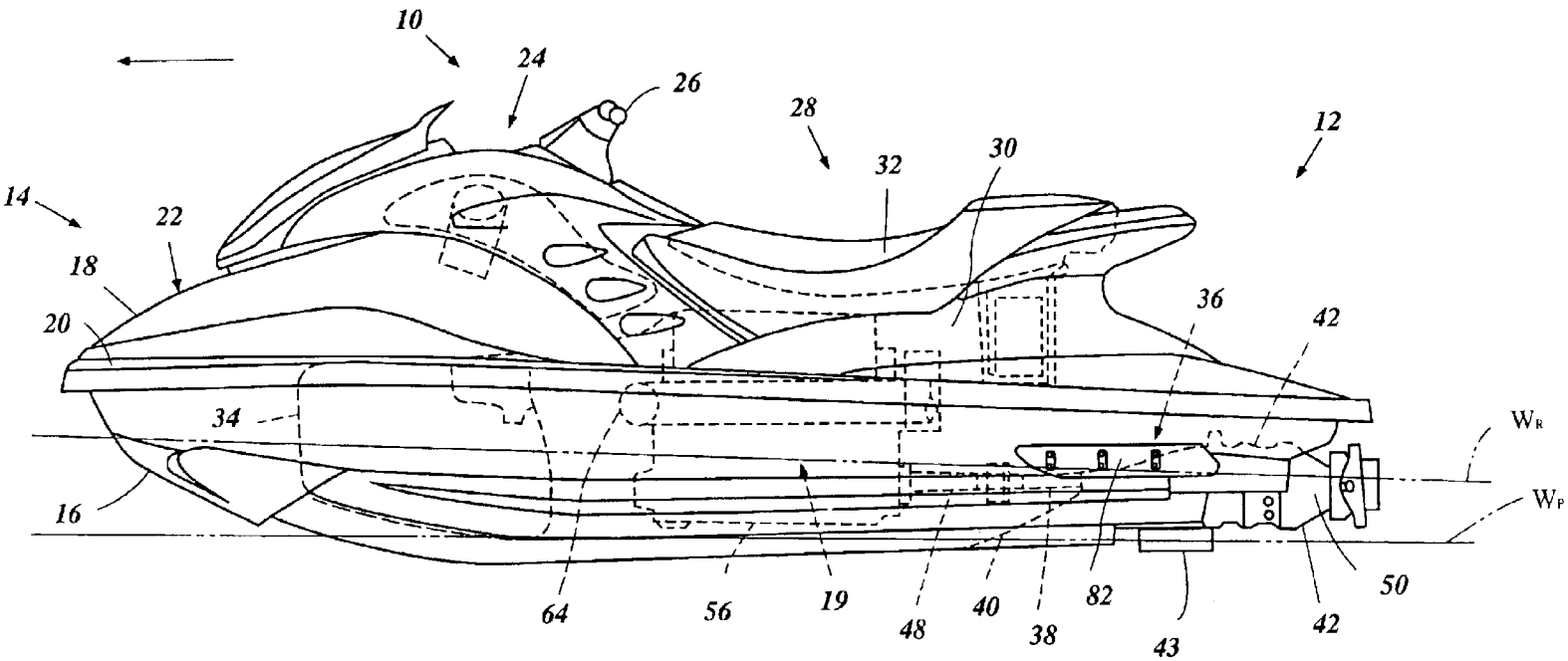
FIG. 1 is a side elevational view of a personal watercraft with certain internal components, including a fuel tank, an engine, and part of a drive train, shown in phantom.
Figure 2:
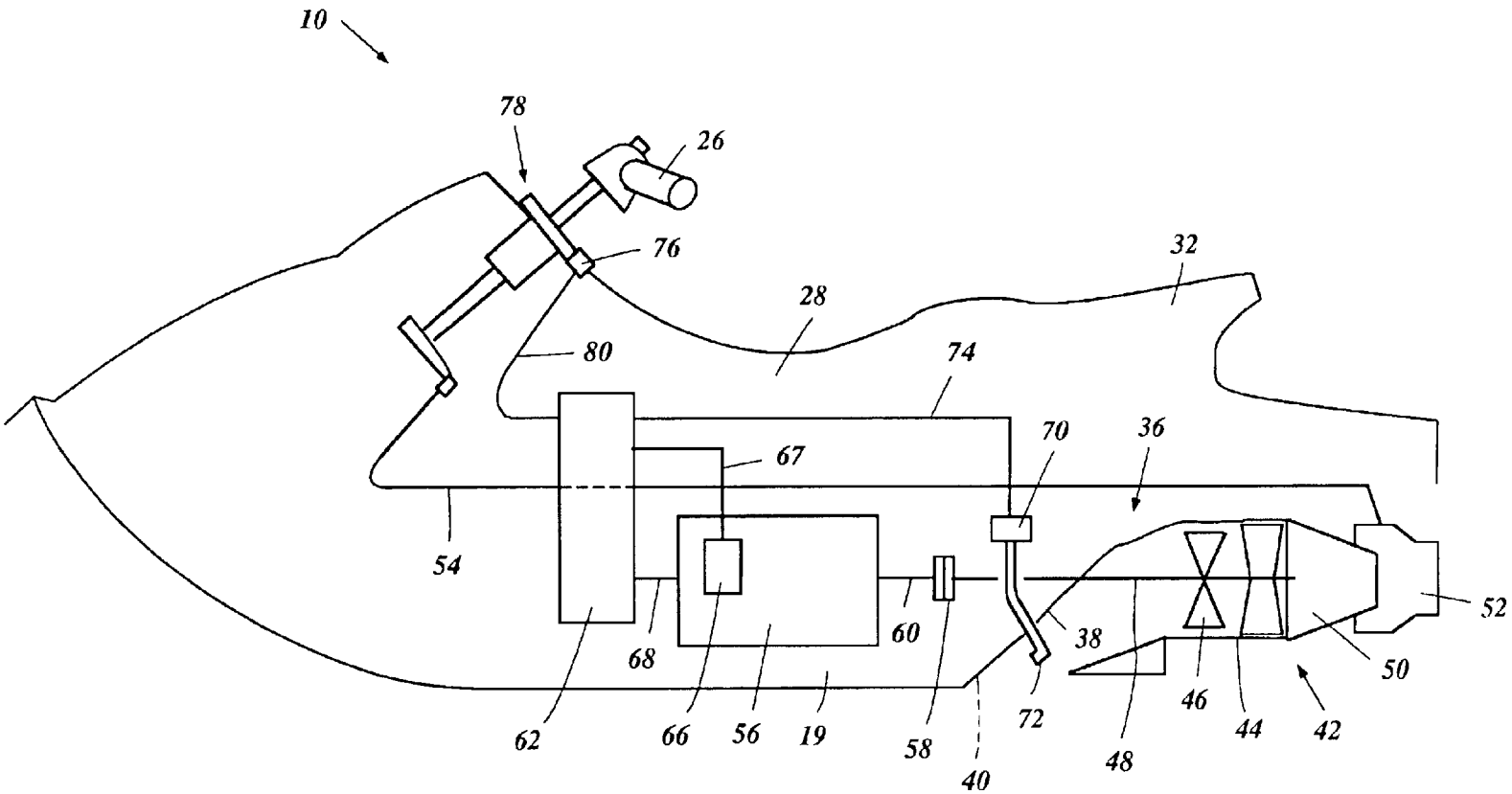
FIG. 2 is schematic side elevational view of the watercraft shown in FIG. 1 illustrating portions of a control system included therein.

With primary reference to FIG. 1 and additionally to FIGS. 2 and 3, an overall configuration of a watercraft 10 is described below. The watercraft 10 includes a sponson control module 12 configured in accordance with a preferred embodiment of the present invention. The sponson control module 12 has particular utility with small watercraft, and is thus described in the context of a personal watercraft. The control module, however, can be applied to other types of watercraft as well, such as, for example, small jet boats and the like.

The watercraft 10 includes a hull 14 which comprises a lower hull section 16 and an upper deck section 18. The lower hull section 16 may include one or more inner liner sections to strengthen the hull or to provide mounting platforms for various internal components of the watercraft 10. Both the hull sections 16, 18 are made of, for example, a molded fiberglass reinforced resin or a sheet molding compound. The lower hull section 16 and the upper hull section 18 are coupled together to define an internal cavity 19. The sections 16, 18 are connected together along a bond flange 20. An engine compartment may be an area within the internal cavity 19 or may be divided from one or more other areas of the internal cavity 19 by one or more bulkheads (not shown).

A bow portion 22 of the watercraft 10 slopes upwardly from the front of the watercraft 10 toward the rear. Rearward from the bow portion 22, a control mast 24 is supported by the upper deck. The control mast 24 supports a handlebar 26 for pivotal movement about a steering axis.

The handlebar 26 is provided primarily for a rider to control the direction in which the watercraft 10 travels. The handlebar 26 also carries other control devices such as, for example, but without limitation, a throttle level lever (not shown). The throttle lever is one type of a throttle operator that can be used with the present watercraft 10. Additionally, the throttle lever can be directly connected to the throttle valves of the engine (described below), or can be configured to generate and transmit a digital or analog signal which is used by the engine as a load or torque request from the operator. In such an embodiment, the load or torque request is used to control an electric motor for moving the throttle valves or another device for controlling the power output of the engine.

A seat 28 extends longitudinally along a center line of the hull 14 at a location behind the control mast 24. Thus, the area behind the control mast 24 defines a rider's area. The seat 28 has a generally saddle type shape so that a rider can straddle the seat 28 during operation. The seat is generally formed of seat pedestal 30 defined by the upper hull section 18 and a cushion 32. The cushion 32, which preferably includes a rigid backing, is supported by the seat pedestal 30. The seat cushion 32 preferably is detachably connected to the pedestal 30.

An access opening (not shown) is defined in an upper surface of the pedestal 30. Preferably, the cushion 32 closes the access opening when it is connected to the pedestal 30. The access opening preferably is sized to allow an operator to access the engine compartment 19.

A fuel tank 34 is supported within the internal cavity 19. The fuel tank 34 is coupled with a fuel inlet port positioned on a top surface of the upper hull section 18 via a filler duct. A closure cap (not shown) closes the fuel inlet port.

At least a pair of air ducts or ventilation ducts are provided on both sides of the upper hull section 18 so that ambient air can be enter the internal cavity 19 through the ducts. Except for the air ducts, the internal cavity 19 is substantially sealed so as to prevent water invasion into internal cavity 19.

A jet propulsion system 36 is configured to propel the watercraft 10. The jet propulsion system 36 includes a tunnel 38 formed on an underside of the lower hull section 16. In some hull designs, the tunnel 38 is isolated from the engine compartment by a bulk head.

The tunnel 38 includes a downwardly facing inlet port 40 opening toward a body water in which the watercraft 10 is operating. For example, the line $W_R$ illustrated in FIG. 1 shows the approximate water level of the watercraft 10 when the watercraft 10 is at rest in a body of water. The line $W_P$ represents the water line when the watercraft 10 is planing along the surface of the body of water in which the watercraft 10 is operating.

The port 40 is positioned so that water can be drawn into the jet propulsion system 36 when the watercraft is floating at the waterline $W_R$ or planing at the line $W_P$. A jet pump unit 42 is disposed within the tunnel 38 so as to communicate with the port 40. The jet pump unit 42 includes a jet pump housing 44. An impeller 46 is disposed within the housing 44 so as to be rotatable about an impeller axis. A ride plate 43 closes a bottom of the tunnel 38.

An impeller shaft 48 extends forwardly from the impeller 46 into the internal cavity 19. The impeller shaft 48 can be a single shaft both rotatably supporting the impeller within the housing 44 and driving the impeller 46, or can be formed from a plurality of shafts.

At the rear end of the housing 44, a discharge nozzle 50 is disposed. Additionally, a deflector or "steering" nozzle 52 is pivotally mounted to a discharge end of the nozzle 50. In particular, the deflector nozzle 52 is mounted for pivotal movement about a generally vertically extending axis. A steering mechanism 54 connects the steering deflector 52 with the handlebar 26. The mechanism 54 can be Bowden-wire type actuator, which is well known in the art. Together, the handlebar 26, steering device 54 and the deflector nozzle 52 define the steering system for the watercraft 10, the handlebar 26 defining a steering input device.

The watercraft 10 also includes an engine 56 disposed within the internal cavity 19. The engine 56 can be disposed within in a separate part of the internal cavity 19 with defining an engine compartment, which may be separated from the remainder of the internal cavity 19 by one or more bulkheads (not shown).

Preferably, the engine 56 operates at a four stroke combustion principle. Thus, the engine 56 preferably includes a cylinder block defining at least one cylinder bore, a piston reciprocally mounted within the cylinder bore, and a cylinder head closing an upper end of the cylinder bore. Together, the cylinder head, cylinder bore, and piston define a combustion chamber therein.

A lower end of the engine 56 preferably includes a crank case. A crank shaft is disposed within the crank case. Together, the cylinder head, cylinder block, and crank case define the engine body of the engine 56.

The crank shaft of the engine 56 can extend rearwardly from the engine body to a coupling device 58. The coupling device 58 can connect the crank shaft to the impeller shaft 48. Preferably, a transmission is disposed within the crank shaft or connected to a rear portion of the engine 56 which drives an output shaft 60. Preferably, the transmission includes a gear reduction to drive the output shaft 60 at a speed lower than the crank shaft of the engine 56. Thus, the engine 56 can run at speeds that are more efficient for a four cycle engine while allowing the impeller shaft to rotate at speeds that are more efficient for a jet pump.

The engine 56 preferably includes an air induction system (not shown) configured to guide air to the combustion chamber of the engine 56. Preferably, the induction system includes an air silencing device for reducing the noise associated with the movement of induction air. Additionally, the induction system preferably is configured to reduce the likelihood of water being ingested into the induction system during operation of the engine 56.

A throttle body (not shown) is disposed within the induction system to regulate or meter an amount of air flowing there through. The throttle valve can comprise a throttle body having a butterfly-type valve mounted therein. Of course, other types of metering systems can be used in place of a throttle device having a butterfly-type throttle valve.

As noted above, a throttle actuator cable can connect the throttle level on the handlebar 26 to the throttle valve of the engine 56. Alternatively, a throttle lever position sensor can be mounted for communication with a throttle level to generate and transmit a signal indicative of the position of a throttle lever. As such, the signal is also indicative of an engine load or torque request from an operator of the watercraft 10. Using this design, the throttle valve can be operated by an electric actuator configured to control the opening of the throttle valve in accordance with the load or torque request indicated by the operator.

The engine 56 also includes a fuel supply system. The fuel supply system includes the fuel tank 34 (FIG. 1), a charge forming device, and a fuel delivery mechanism that connects the fuel tank with the charge forming device. The charge forming device can be any one of a number of fuel charge forming devices known in the art. For example, but without limitation, the charge forming device can be a carburetor, a fuel injector configured to inject fuel into the induction system, or fuel injector configured to inject fuel directly into the combustion chamber. Preferably, the charge former is a fuel injector.

Each fuel injector includes a solenoid operating a fuel valve. When the solenoid is activated, the fuel valve is opened, thereby allowing pressurized fuel to be sprayed through the fuel injector. The sprayed fuel is mixed with air for combustion in the combustion chamber.

Preferably, the watercraft 10 also includes a feedback control system for controlling various aspects of the operation of the engine 56. For example, the feedback control system can include an electronic control unit (ECU) 60 which receives signals from various sensors and outputs control signals to various actuators, described in greater detail below. Preferably, where the fuel system of the watercraft 10 comprises a fuel injection system, the ECU 60 controls the timing and duration of fuel injection from the fuel injectors. The ECU 60 can also be configured to control other parts of the fuel system, for example, but without limitation, a fuel pump for maintaining a predetermined pressure in the fuel system.

The engine 56 also includes an ignition or firing system. Spark plugs (not shown) of the ignition system are fixed to the cylinder head of the engine 56. A spark gap of each spark plug is exposed within an associated combustion chamber. Each spark plug ignites an air fuel charge at an ignition timing controlled by the ECU 60 as part of the feed-back control system.

The ignition system preferably includes an ignition mechanism having an ignition coil and an igniter. The ignition coil preferably is a combination of a primary coil element and a secondary coil element that are wound around a common core. The secondary coil element is connected to the spark plugs while the primary coil element is connected to the igniter. The primary coil element also is coupled with a power source (e.g., a battery). The igniter abruptly cuts-off the current flow in response to an ignition timing control signal from the ECU 60. A high voltage current flow consequently occurs in the secondary coil element. The high voltage current flow forms a spark at each spark plug. The ECU 60 controls the ignition timing of the spark plugs in accordance with any known strategy as part of the feedback control system.

The engine 56 further includes an exhaust system configured to discharge burnt air fuel charges, i.e., exhaust gases, from the combustion chambers therein. Exhaust ports are defined in the cylinder head (where the engine 56 is a four cycle engine) and communicate with associated combustion chambers. An exhaust manifold connects the individual ports to a common exhaust pipe. The exhaust pipe can merge the individual exhaust gas passages defined by the port into a single passage, or can extend the individual exhaust paths to a point further down stream in the exhaust system. For example, multiple exhaust pipes 64 can extend around a part of the engine 56. At any point along the exhaust pipes, the exhaust passages can be merged together into a single exhaust gas passage. Additionally, another exhaust pipe extends around the other side of the engine 56 to an exhaust discharge opening to the atmosphere. Optionally, the exhaust system can include a further exhaust silencer also known as a "water trap," configured for further reducing the likelihood that water can flow upstream to the exhaust system toward the engine. Preferably, the exhaust discharge is disposed in the tunnel below the water line $W_R$.

As noted above, the ECU 62 controls engine operations including fuel injection from the fuel injectors and firing of the spark plugs, according to various control maps stored in the ECU 62. In order to determine appropriate control scenarios, the ECU 62 utilizes maps and/or indicies stored within the ECU 62 with reference to data collected from various sensors. For example, the ECU 62 may refer to data collected from a throttle valve position sensor 66, connected to the ECU 62 via a throttle position data line 67, which is mounted in the vicinity of the throttle valve of the engine 56 so as to detect an angular position, which is indicative of an opening degree, of the throttle valve. Additionally, other sensors can be provided for sensing engine running conditions, environmental conditions, or other conditions of the engine 56 that will affect engine performance.

For example, the watercraft 10 can include one or more plurality of crank shaft position sensors. Such crank shaft position sensors can be configured to provide signals to the ECU 62 indicative of engine speed and/or crank shaft position. The watercraft 10 can also include a combustion condition sensor or oxygen ($O_2$) sensor configured to detect the in-cylinder combustion conditions by sensing a residual amount of oxygen in the combustion products at a point in time approximately when the exhaust port is opened. The output from the oxygen sensor can be transmitted to the ECU 62.

The watercraft 10 can also include a watercraft speed sensor 70. In the illustrated embodiment, the watercraft speed sensor 70 is a pitot-tube type sensor having an opening 72 positioned in the inlet 40 of the tunnel 38. As such, the watercraft speed sensor 70 can generate a signal indicative of the pressure at the opening 40 and transmit the signal to the ECU 62 through an engine speed data line 74. The ECU 62 can be configured to convert the pressure signal to a watercraft speed. Alternatively, the watercraft speed sensor 70 can be of any known type of watercraft speed sensor, for example, but without limitation, a paddle wheel. Additionally, the sensor 70 or another sensor used for detecting watercraft speed, can be mounted at other locations on the watercraft 10. For example, but without limitation, on the ride plate 43.

The watercraft 10 can also include a steering sensor 76. In the illustrated embodiment, the steering sensor 76 is mounted adjacent to the handlebar 26. In particular, the steering sensor 76 is mounted adjacent to a mounting assembly 78 of the handlebar 26. The steering sensor 76 can be configured to detect if the angle at which the handlebars are turned, is greater than a predetermined magnitude. Preferably, the steering sensor 76 can detect the magnitude of the angle at which the handlebars 26 are turned from a center position. Additionally, the sensor 76 preferably is configured to detect whether the handlebars 26 are turned toward the port or starboard sides.

The sensor 76 is also configured to transmit a signal to the ECU 62. For example, the sensor 76 can transmit a steering signal to the ECU 62 via a steering data line 80.

The above-noted sensor correspond to merely some of those conditions which may be sensed for purposes of engine control. It is, of course, practicable to provide other sensors such an intake air pressure sensor, intake air temperature sensor, a trim angle sensor, a knock sensor, a watercraft pitch sensor, and an atmospheric temperature sensor in accordance with various control strategies.

Figure 3:
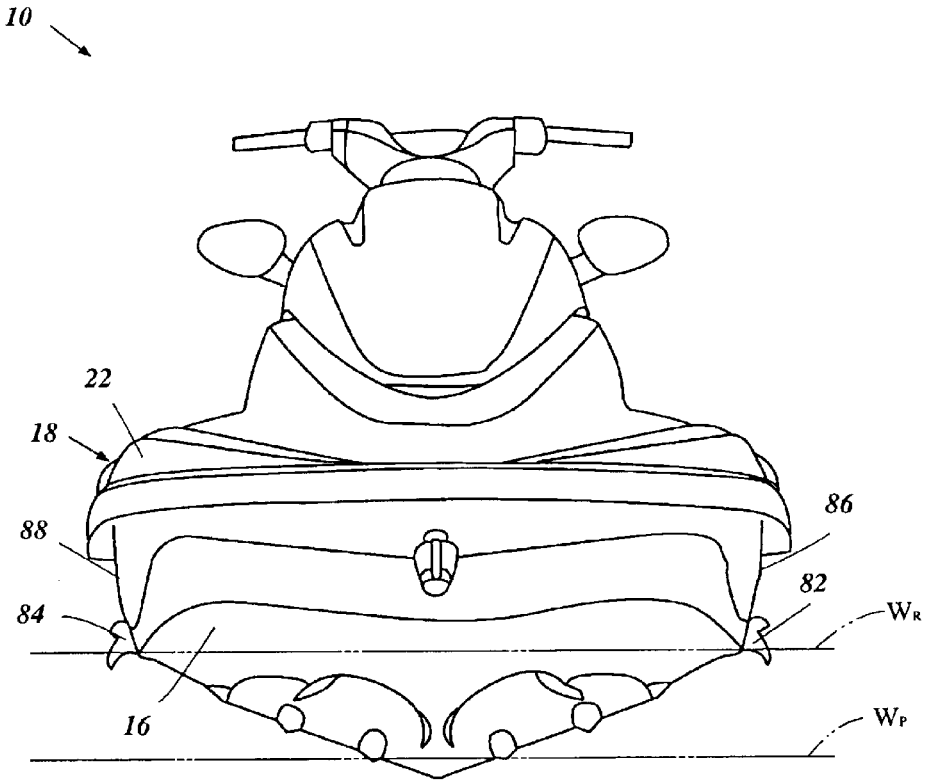
FIG. 3 is a front elevational view of the watercraft shown in FIG. 1 and including sponsons on port and starboard sides thereof.

With reference to FIG. 3, the watercraft 10 also includes a port side sponson 82 and a starboard side sponson 84. As shown in FIG. 3, the sponsons 82, 84, are disposed so as to contact the surface of the water when the watercraft 10 is floating on a surface of a body of water at the waterline $W_R$. The sponsons 82, 84 are connected to lateral side surfaces 86, 88, respectfully, of the lower hull section 16. The illustrated position is a preferred position, but it is not necessary for the sponsons 82, 84 to be mounted in the illustrated position.

Figure 4:
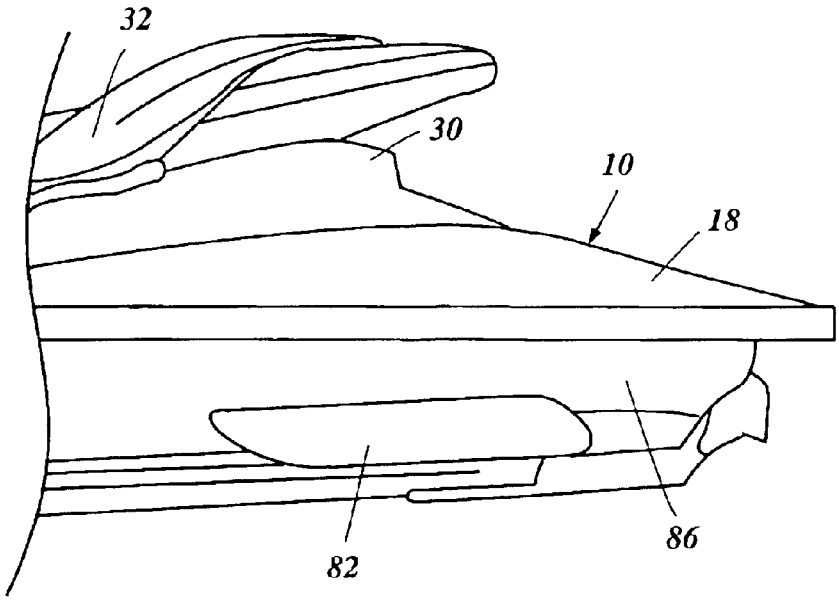
FIG. 4 is an enlarged port side elevational view of the watercraft shown in FIG. 1, and illustrating a retracted position of the port side sponson.
Figure 5:
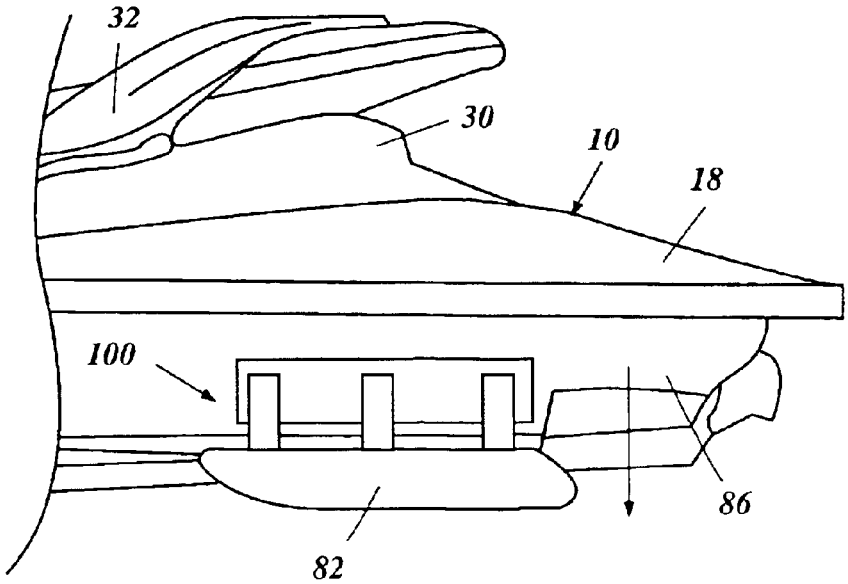
FIG. 5 is an enlarged port side view of the watercraft illustrated in FIG. 4, with the sponson in a deployed position.
Figure 6:
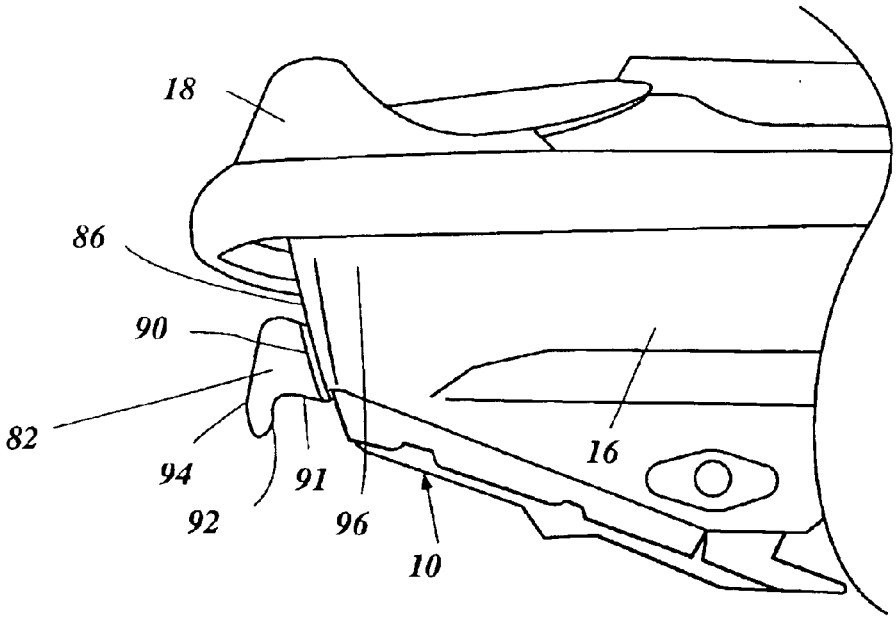
FIG. 6 is an enlarged rear elevational view of the watercraft illustrated in FIG. 4 with the sponson in an retracted position.
Figure 7:
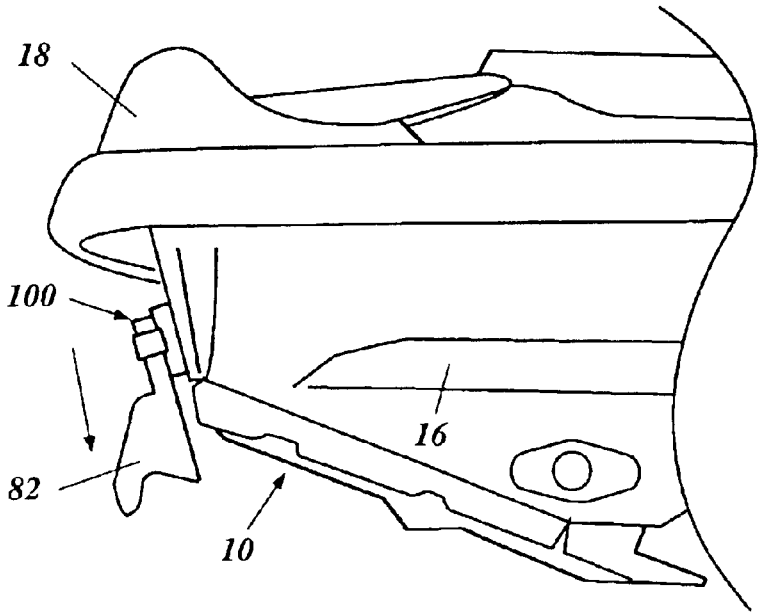
FIG. 7 is a rear elevational view of the watercraft illustrated in FIG. 6 with the sponson in the deployed position.

As noted above, the watercraft 10 includes a sponson module 12 for moving at least one of the sponsons 82, 84 relative to the hull 14, between a retracted position and a deployed position. FIGS. 3, 4 and 6 illustrate the retracted position of the sponson 82. FIGS. 5 and 7 illustrate a deployed position of the sponson 82.

With reference to FIG. 6, the sponson 82 includes an inner surface 90 which faces toward the lateral side surface 86 of the lower hull 16. A second surface 92 of the sponson 82 extends outwardly from the lower edge of the surface 90. The third surface extends generally downwardly from the second surface 90, toward a body of water in which the watercraft 10 can operate. The sponson 82 also includes an outer surface 94 extending from the lower edge of the surface 92 and faces in a direction away from the outer side surface 86 of the lower hull portion 16.

As shown in FIG. 6, in the retracted position, the sponson 82 is mounted such that the intersection of the inner surface 90 and the second outwardly extending surface 91 is at about an outer chine 96 of the lower hull section 16. As such, the sponson 82 provides additional traction for the watercraft 10 when the watercraft is in a turn.

Sponsons such as the sponson 82 are particularly useful for small planing-type watercraft during turns at planing speeds. Because of the relatively low profile of the sponson body 82, the sponson 82 provides a limited amount of traction along the surface of the water in which the watercraft 10 is operating. Thus, the traction provided by the sponson 82 is proportional with watercraft speed 10 and the turning angle, yet is limited as compared to watercraft which have rudders, and thus provides a substantially different effect than that generated by rudders.

With reference to FIGS. 4 and 5, the sponson 82 is positioned approximately at the stern of the watercraft 10 and has a length substantially shorter than the length of the hull 14. In the illustrated embodiment, the sponson 82 has a length roughly equal to about $1/6_{th}$ of the watercraft 10. For heavier watercraft or for watercraft designed to accommodated multiple passengers, however, longer sponsons can be used.

With reference to FIGS. 3 and 6, the shape of the sponson 82 tapers from its aft end to a generally blunt nose positioned at its fore end to give the body of the sponson 82 a substantially streamline shape in a direction of water flow over the sponson 82. Thus, the lateral width of the sponson 82 increases from its blunt nose to its aft end.

The outer surface 94 of the sponson 82 also tapers in size in the vertical direction (i.e., in a direction generally normal to the water surface $W_R$) such that the outer portion smoothly transitions into the blunt nose of the sponson body 82 in the fore direction. The size and shape of the sponson body 82 is desirably selected according to the preference of a rider and the number of riders. It is contemplated that other shapes and sizes of sponson bodies 82 can be used.

With reference to FIGS. 5 and 7, a guide mechanism 100 secures the sponson 82 to the lower hull 16 and is configured to allow the sponson 82 to move from the retracted position illustrated in FIG. 6 to the deployed position illustrated in FIG. 7.

It has been found that by moving the sponson 82 from its retracted position to a deployed position, for example, but without limitation, in a direction generally downward, or generally outward from the side surface 86 of the hull 16, the resulting increase in hydrodynamic resistance can be sufficient to cause the watercraft 10 to turn when the watercraft 10 is moving under its own momentum, with the engine at a lower speed than that which is sufficient to cause the watercraft to turn quickly under the force of the water jet deflected by the deflector nozzle 52. For example, when the watercraft is operated at low speed in a water displacement mode, i.e., when the watercraft is moving through the water at the waterline $W_R$, fine adjustments to the attitude of the watercraft can be difficult, such as when the watercraft is being driven toward a dock for docking maneuver, or onto a trailer to remove the watercraft 10 from the water. It has been found by moving the sponson 82 relative to the hull 16, the increased hydrodynamic resistance used to convert the forward momentum of the watercraft 10 into yaw to thereby change the attitude or direction in which the watercraft travels.

The guide mechanism 100 is configured to allow the sponson 82 to move along a fixed path with one degree of motion between the retracted position (FIG. 6) and the deployed position (FIG. 7). This provides a further advantage in that the sponson 82 can be held more rigidly in the deployed position. Thus, further movement from the sponson 82, e.g., in a direction prependicular to the movement allowed by the guide 100, is prevented which could otherwise cause fluctuations in the effects provided by the sponson 82 in the deployed position.

Figure 8:
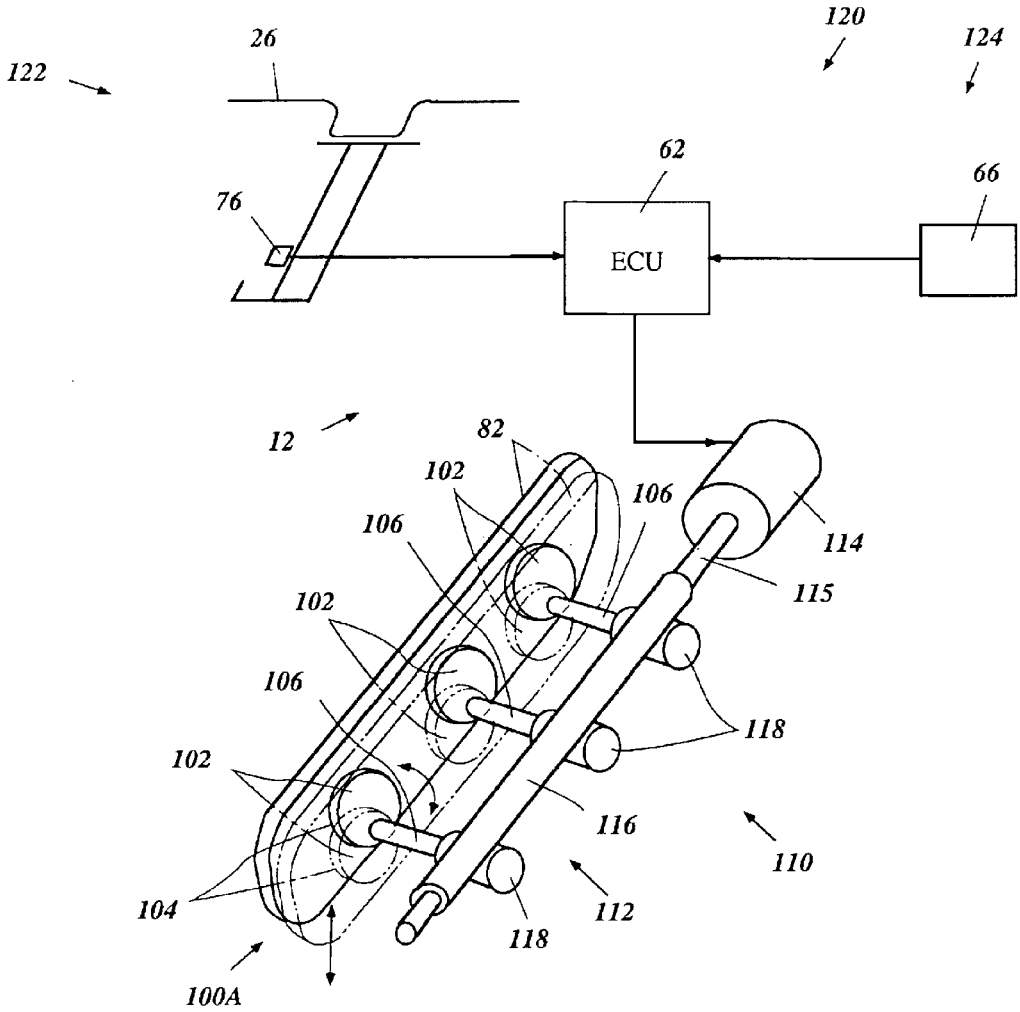
FIG. 8 is a schematic illustration of a sponson module included in the watercraft illustrated in FIG. 1 and including the sponson illustrated in FIGS. 4–5.

With reference to FIG. 8, a modification of the guide mechanism 100 is illustrated therein and identified generally by the reference numeral 100A. In the illustrated embodiment, the guide mechanism 100A includes three circular disks 102, which are contained within the sponson 82 so as to be rotatable relative to the sponson 82. Thus, the sponson 82, in this embodiment, includes a plurality of circular holes 104. Plugs (not shown) preferably are disposed on either side of the disks 102 to enclose each of the disks 102 in place within the holes 104. Each of the circular disks 102, as well as the plugs at least on the inner side of the sponson 82, include a through hole.

A rotational shaft 106 is connected to each of the disks 102. The shaft 106 desirably includes external splines which cooperate with internal splines formed within the hole of the circular disks 102. The shafts 106 extend from the inner side of the disks 102 through a hole in the inner plug element of the sponson body 82. A fastener (not shown) engages the outer end of each shaft through the hole of the outer sponson body plug to secure the sponson body 82 onto the shafts 106.

Each shaft 106 is supported by a bushing (not shown) positioned within a hole that extends through the sidewall 86 of the lower hull 16. Each bushing includes a flange which mates against an inner surface of the sidewall 86 and includes an angular collar (not shown) which extends through the wall 86 and fits within a counter bore formed within the inner plug elements of the sponson body 82.

The bushing also includes a central hole through which the corresponding shaft 106 extends. A seal (not shown) is placed between the bushing and the shaft to prevent ingress of water into the hull 14 through the hull in the sidewall 86. In this matter, each bushing supports the corresponding rotational shaft 106 permits rotational movement of the shaft 106 relative to the bushing and the seal. The shaft 106, in turn, couples the sponson 82 to the sidewall 86.

The shaft 106 and disks 102 also define a travel path of the sponson 82 relative to the sidewall 86. Each shaft 106 is eccentrically positioned on the respective disk 102. Thus, rotational movement of the shaft 106 about a fixed rotational axis causes the attached sponson body 82 to move vertically relative to the rotational axis. In the illustrated embodiment, the shafts 106 desirably rotate 180 degrees from a fully raised position (the retracted position illustrated in FIG. 6) to a fully deployed position (illustrated in phantom).

An actuator 110 is configured to move the sponson 82 between the retracted and deployed positions. In the illustrated embodiment, the actuator 110 comprises a gear train 112 driven by a motor 114. The gear train 112 includes a worm gear 116 which drives a plurality of pinions 118.

Each rotational shaft 102 supports one the pinions 118 on its inner side, i.e., a side of the shaft 106 that extends into the hull 14. In the illustrated embodiment, the inner end of each shaft 106 includes an external spline which cooperates with an internal spline of the pinion 118. A suitable fastener holds the pinion 118 onto the shaft 116.

The worm gear 116 cooperates with the pinions 118. The worm gear 116 includes a corresponding thread arrangement which cooperates with the teeth of the pinions 118 in a known manner. The worm gear 116 desirably is held in a meshing engagement with the pinions 118 and is suitably journaled for rotation relative to the pinions 118. In this manner, rotation of the worm gear 116, drives the pinions 118 to rotate the rotatable shafts 106 in unison.

The motor 114 can be an electric reversible stepper motor or similar type of reversible actuator motor which drives the worm gear 116, through a shaft 115, in a rotational directions so as to raise and lower the sponson 82. By rotating the worm gear 116 in the first direction, the worm gear 116 rotates the pinions 118 and corresponding rotational shafts 106 in corresponding direction (e.g., clockwise direction) to raise the sponson 82. That is, the rotational movement of the eccentrically positioned shafts 106 rotates the circular disks 102 upwardly. As a result, the sponson 82 moves upwardly to a raised position. Likewise, by rotating the worm gear 116 in an opposite direction, the circular disks 102 are rotated in an opposite direction (e.g., counter clockwise direction), to lower the sponson 82.

Once the position of the sponson has been adjusted, the inertia of the motor 114 and the gear train 112 generally inhibit movement of the sponson 82 relative to the sidewall 86. In addition, the motor 114 (particularly in the case of a stepper-type motor) may include a self-locking feature to prevent unintentional rotation of the worm gear 116. In this manner, the actuator 110 provides a locking mechanism to inhibit unintended movement of the corresponding sponson 82.

In the illustrated embodiment, the sponson module 12 includes a control module 120 for controlling the actuator 110. In the illustrated embodiment, the control module 120 includes a steering input module 122 and an engine load input module 124.

The steering input module 122 is configured to detect a steering request from the operator of the watercraft 10, and generate a signal indicative of the steering request from the operator of the watercraft 10. In the illustrated embodiment, the steering angle input module 122 comprises the handlebars 26 and the steering sensor 76.

The engine load request module 124 is configured to detect an engine load request form the operator of the watercraft 10 and generate a signal indicative of the load request. In the illustrated embodiment, the engine load request module 124 comprises the throttle valve position sensor 66.

The control module 120 also includes a controller for receiving the signals from the steering input module 122 and the engine load input module 124 and for controlling the actuator 110 in accordance with these signals. In the illustrated embodiment, the control module 120 includes the ECU 62. However, the control module 120 can alternatively be constructed of a hardwired electronic device, a dedicated processor with a memory for running one or a plurality of control routines, or general purpose processor and memory for running one or a plurality of control routines.

The control module 120 is configured to energize the motor 114 in accordance with signals from the steering sensor 76 and the throttle valve position sensor 66. In one preferred embodiment, the control module 120 is configured to determine if the engine load request form the operator of the watercraft 10 is below a predetermined threshold. For example, the predetermined threshold can be a zero load request, i.e., where the operator of the watercraft 10 has released the throttle valve, thereby allowing the engine 56 to operate at idle speed.

Additionally, the control module 120 is configured to determine if the operator of the watercraft 10 desires the watercraft 10 to turn. For example, control module 120 can compare the output of the steering input module 122 with a predetermined steering angle. Specifically, in the illustrated embodiment, the control module 120 determines whether the signal from the steering sensor 76 is greater than a predetermined threshold. The control module 120 can be configured to actuate the motor 114 if the throttle opening is below the predetermined threshold and if the handlebars 26 are turned beyond a predetermined threshold. For example, but without limitation, if it is determined that the throttle valve is closed and if the handlebars are turned to the port side greater than a predetermined degree, the ECU 62 can energize the motor 114 to lower the sponson 82.

When the sponson 82 moves to the lower most position (illustrated in phantom in FIG. 8) the hydrodynamic drag generated by the sponson 82 is larger than that created by the sponson 84. The resulting increase in hydrodynamic drag on the sponson 82 generates a torque or yaw causing the watercraft 10 to rotate about a generally vertical axis, thereby turning the watercraft to the port side.

The control module 120 can also be configured to return the sponson 82 to the retracted position (solid line in FIG. 8) if either the throttle valve is opened above the predetermined threshold or the handlebars 26 are returned to a steering angle that is less than the predetermined threshold.

Throughout the descriptions set forth above, referencing FIG. 8, only the port-side sponson 82 was described. However, the sponson 84 (FIG. 3) can include an actuator configured identically or substantially similarly to the actuator 110. Additionally, the actuator for the sponson 84 can be connected to the ECU 62 in the same manner as that of the actuator 110. As such, the control module 120 is configured to actuate the actuator for the sponson 84 to lower the sponson 84 if the handlebars 26 are turned to the starboard side beyond a predetermined threshold and if the throttle valve opening is smaller than the predetermined threshold, in a manner identical or similar to that described above with reference to the actuator 110.

Figure 9:
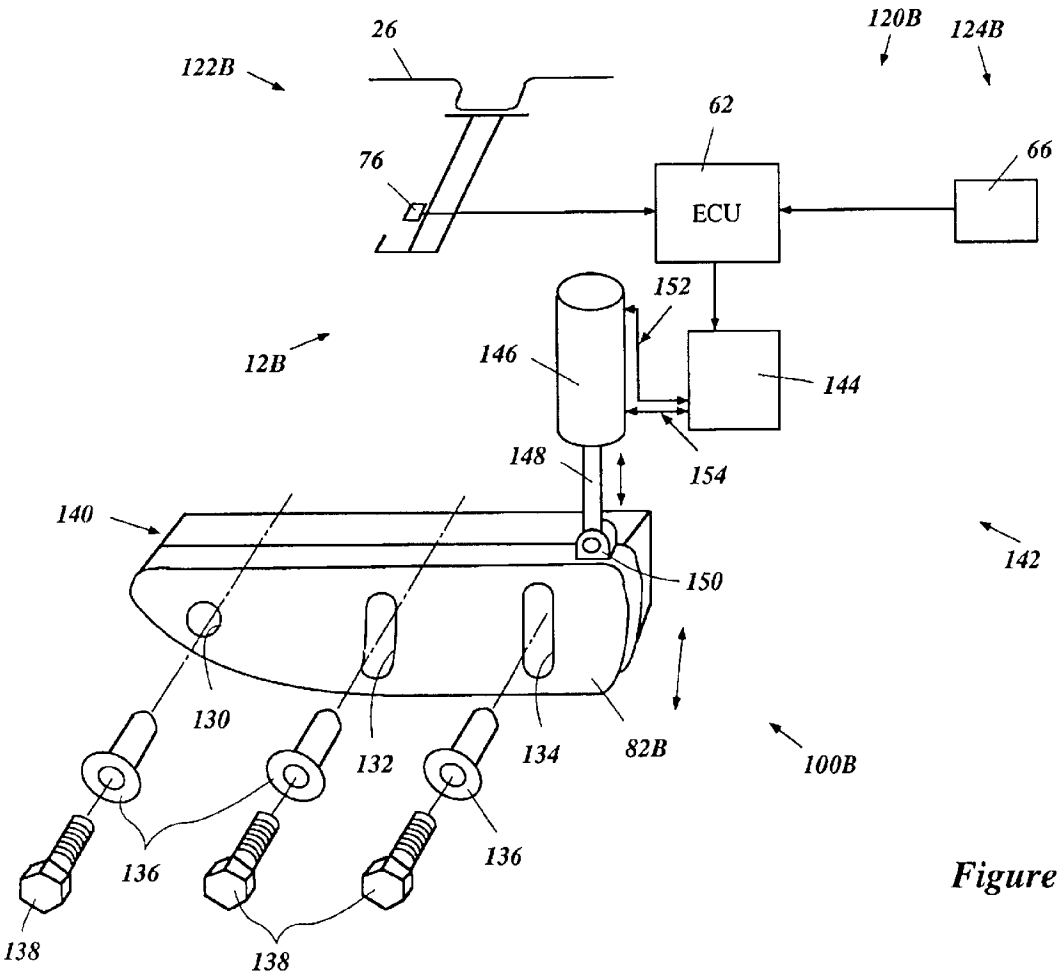
FIG. 9 is a schematic illustration of a modification of the sponson module illustrated in FIG. 8.

With reference to FIG. 9, a modification to the module 12 is illustrated therein and identified generally by the reference numeral 12B. Components of the module 12B, which are the same as the module 12 illustrated in FIG. 8, are identified using the same reference numerals, except that a "B" has been added. These components can be the same as the corresponding components in the sponson module 12, except as noted below.

The module 12B includes a guide mechanism 100B that is configured to allow the sponson 82B to move along an arcuate fixed path between a deployed and retracted position. In the illustrated embodiment, the sponson 82B includes a pivot aperture 130. Rearward from the pivot aperture 130, the sponson 82B includes at least one arcuate guide aperture. In the illustrated embodiment, the sponson 82B includes a first arcuate guide aperture 132 and a second arcuate guide aperture 134 rearward from the aperture 132.

The apertures 132, 134 extend through a radius of curvature having a center along the center axis of the aperture 130. Thus, the radius of curvature of the guide aperture 134 is larger than the radius of curvature of the guide aperture 132.

A sleeve 136 extends through each of the apertures 130, 132, 134. Additionally, each of the sleeves have a seat portion on the outer ends thereof. Bolts 138 extend through each of the sleeves 136 and into the side 86 of the hull 16. Optionally, a mounting base 140 can be used to receive the threaded ends of the bolts 138.

As such, the bolts 138 and sleeves 136, in cooperation with the apertures 130, 132, 134, define the guide mechanism 100B which allows the sponson 82B to move along a fixed path between retracted and deployed positions.

The module 12B also includes an actuator 142. The actuator 142 comprises a hydraulic supply 144 and a hydraulic cylinder 146. The hydraulic cylinder 146 includes an output shaft 148. A lower end of the output shaft 148 is connected to a pivot 150 disposed on the sponson 82B. In the illustrated embodiment, the pivot 150 is disposed at an upper rear portion of the sponson 82B. However, other positions for the pivot 150 can be used.

The hydraulic supply unit 144 is connected to the cylinder 146 with hydraulic lines 152, schematically illustrated in FIG. 9.

The control module 120B, in this embodiment, is configured to control the operation of the hydraulic supply 144. For example, when the handlebar 26 is turned beyond the predetermined threshold, and the throttle valve opening is less than a predetermined degree, the ECU 62 triggers the hydraulic supply 144 to lower the sponson 82B. In the illustrated embodiment, the sponson 82B is lowered when the hydraulic supply 144 supplies hydraulic fluid to the cylinder 146 through the supply line 152. This causes a piston (not shown) inside the cylinder 146 to be urged downwardly through the cylinder 146. Simultaneously, hydraulic fluid is purged from the cylinder 146 through the hydraulic line 154. When the ECU 62 signals the hydraulic supply 144 to raise the sponson body 82B, the supply 144 supplies pressurized fluid to the cylinder 146 through the hydraulic line 154. Simultaneously, hydraulic fluid is purged from the cylinder 146 through the hydraulic line 152. Preferably, when the sponson 82B is not being moved by the cylinder 146, valves within the supply 144 can prevent the movement of fluid through the lines 152, 154. Thus, the output shaft 148 remains stationary.

In operation, when the sponson 82B is moved downwardly through the arcuate path defined by the guide mechanism 100B, a portion of the sponson 82B is moved deeper into the water, thereby increasing the hydrodynamic drag produced by the sponson body 82B. Thus, as noted above, with respect to the module 100A, the sponson 82B creates a torque which turns the watercraft 10, as the watercraft 10 moves through the water.

Figure 10:
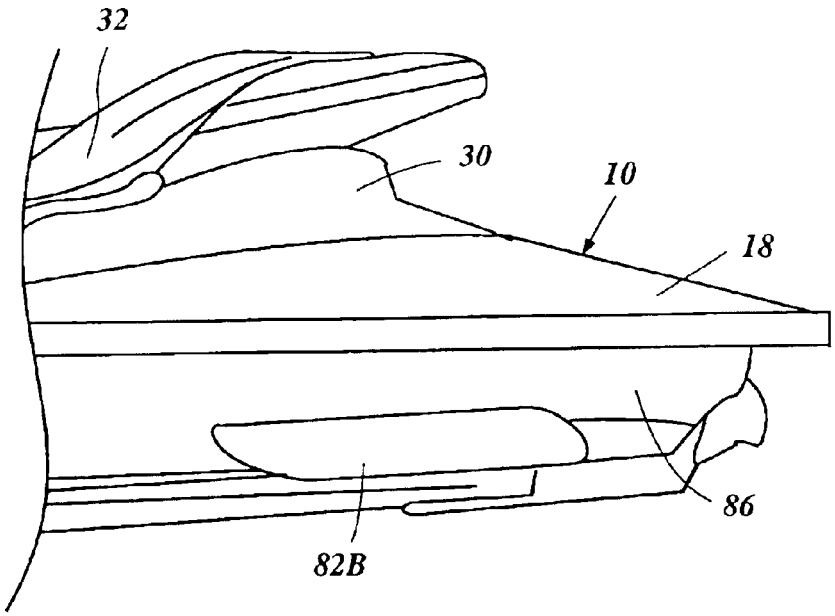
FIG. 10 is an enlarged port-side elevational view of a modification of the watercraft illustrated in FIG. 4, illustrating a sponson of the sponson module illustrated in FIG. 9 in a retracted position.
Figure 11:
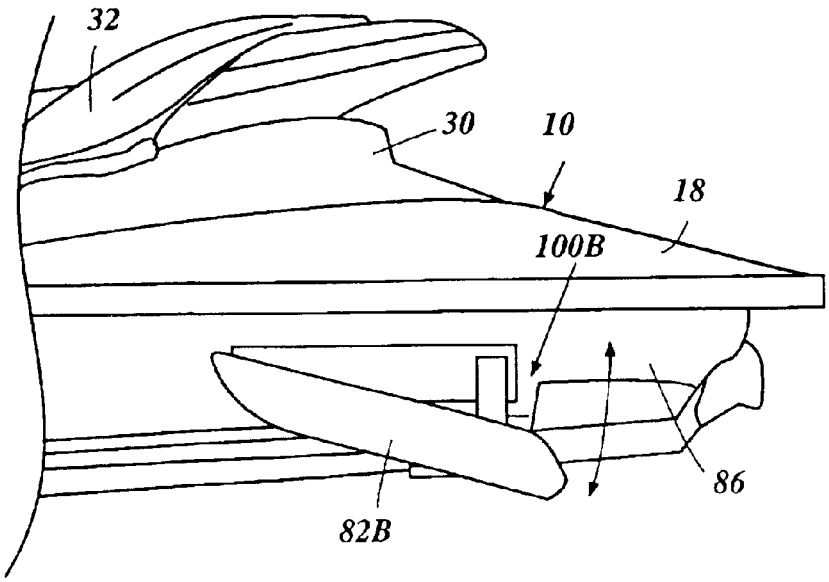
FIG. 11 is an enlarged side elevational view of the watercraft illustrated in FIG. 10 with the sponson illustrated in a deployed position.

For example, as shown in FIG. 10, the sponson 82B is illustrated in the retracted position. After the hydraulic supply 144 is actuated to supply fluid to the cylinder 146 through the line 152, the shaft 148 moves downwardly, thus pivoting the sponson 82B to the position shown in FIG. 11. In this position, a portion of the sponson 82B is moved deeper into the water as compared to the position illustrated in FIG. 10.

As noted above with reference to FIG. 8, when the sponson 82B is moved into the deployed position, the inner surface of the sponson 82B (corresponding to the surface 90 of the sponson 82 in FIG. 6) is now in contact with the body of water in which the watercraft 10 is operating. Thus, the hydrodynamic drag of the sponson 82B is greater in the deployed position than that generated by the retracted position. Additionally, in the position illustrated in FIG. 11, the outwardly extending lower surface of the sponson 82B (corresponding to surface 91 of the sponson 82 in FIG. 6) is inclined with respect to the surface of the water in which the watercraft 10 is operating. The interaction of this now inclined surface against the body of water further enhances the hydrodynamic drag generated by the sponson 82B.

Figure 12:
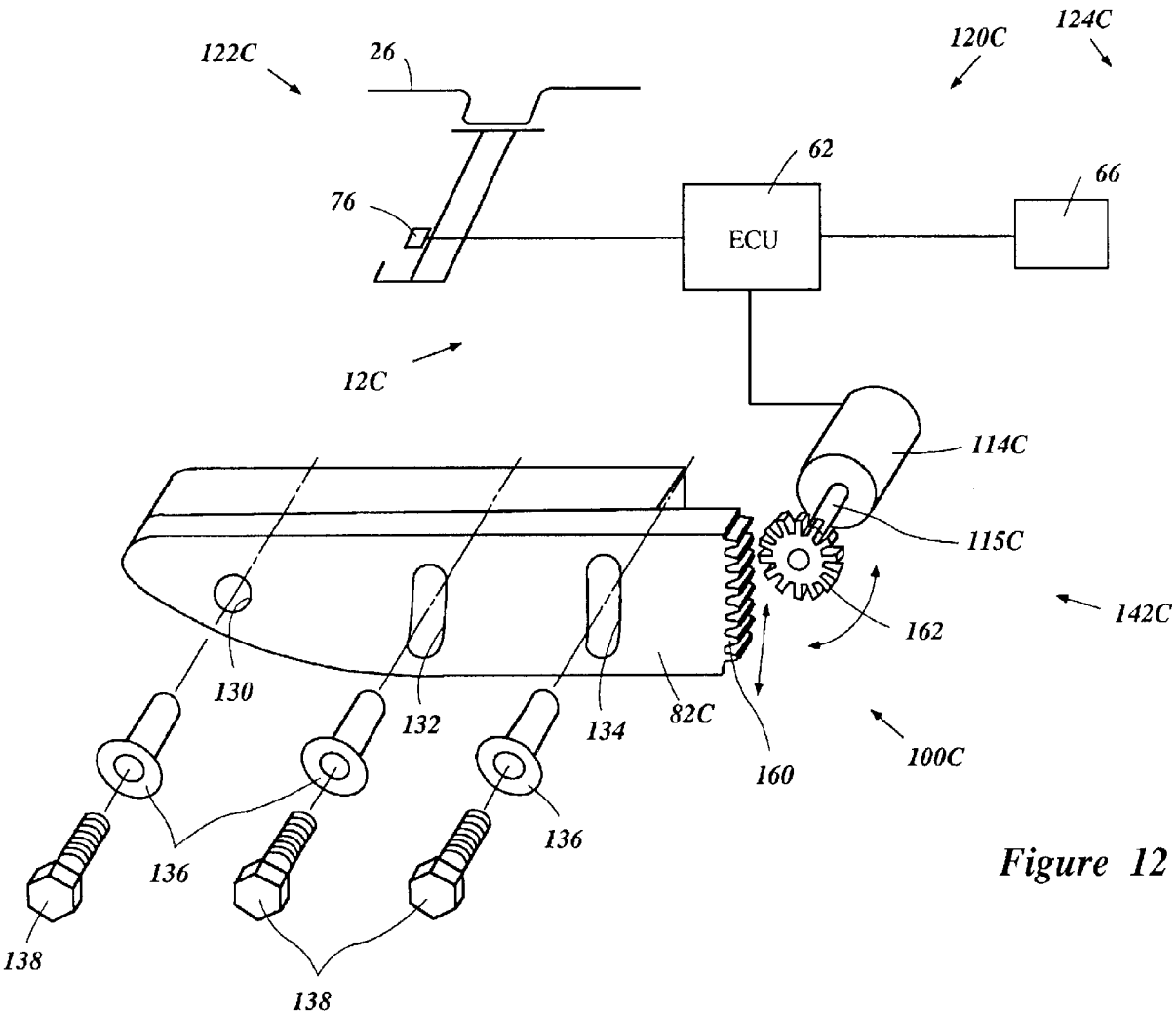
FIG. 12 is a schematic illustration of a modification of the sponson module illustrated in FIG. 9.

With reference to FIG. 12, a modification of the module 12B is illustrated therein and is identified generally by the reference numeral 12C. The components of the module 12C corresponding to the same or similar components of the module 12B are identified using the same reference numerals. These components can be considered to be identical or similar to the components of the module 12B, except as noted below.

In the module 12C, the sponson 82C includes teeth 160 along a rearward edge of the sponson 82C.

The module 12C includes an actuator 142C. The actuator 142C includes a motor 114C driving an output shaft 115C. A gear 162 is connected to the outer end of the shaft 115C. The teeth of the gear 162 are configured to mesh with the teeth 160 on the sponson 82C. Preferably, the motor 114C is mounted within the hull 16. Additionally, at least one seal defining a through hole fitting provides a substantially water-tight seal with the shaft 115C extending therethrough. The motor 114C and the shaft 115C are mounted such that the gear 162 meshes with the teeth 160.

In operation, when the handlebar 26 is turned beyond its predetermined degree toward the port side, and when the opening of the throttle valve is below a predetermined degree, the ECU 62 actuates the actuator 142C to lower the sponson 82C. For example, the ECU 62 can drive the motor 114C such that the shaft 115C rotates in a counterclockwise direction, as viewed in FIG. 12. Thus, through the interaction of the gear 162 with the teeth 160, the rear portion of the sponson 82C is pivoted downwardly to the position of the sponson 82B illustrated in FIG. 11. As noted above with respect to the motor 114 illustrated in FIG. 8, the motor 114C can be an electric stepper motor and, optionally, can include a self-locking feature. Thus, the sponson 82C can be held rigidly in the positions including in-between a fully retracted position and a fully deployed position.

Figure 13:
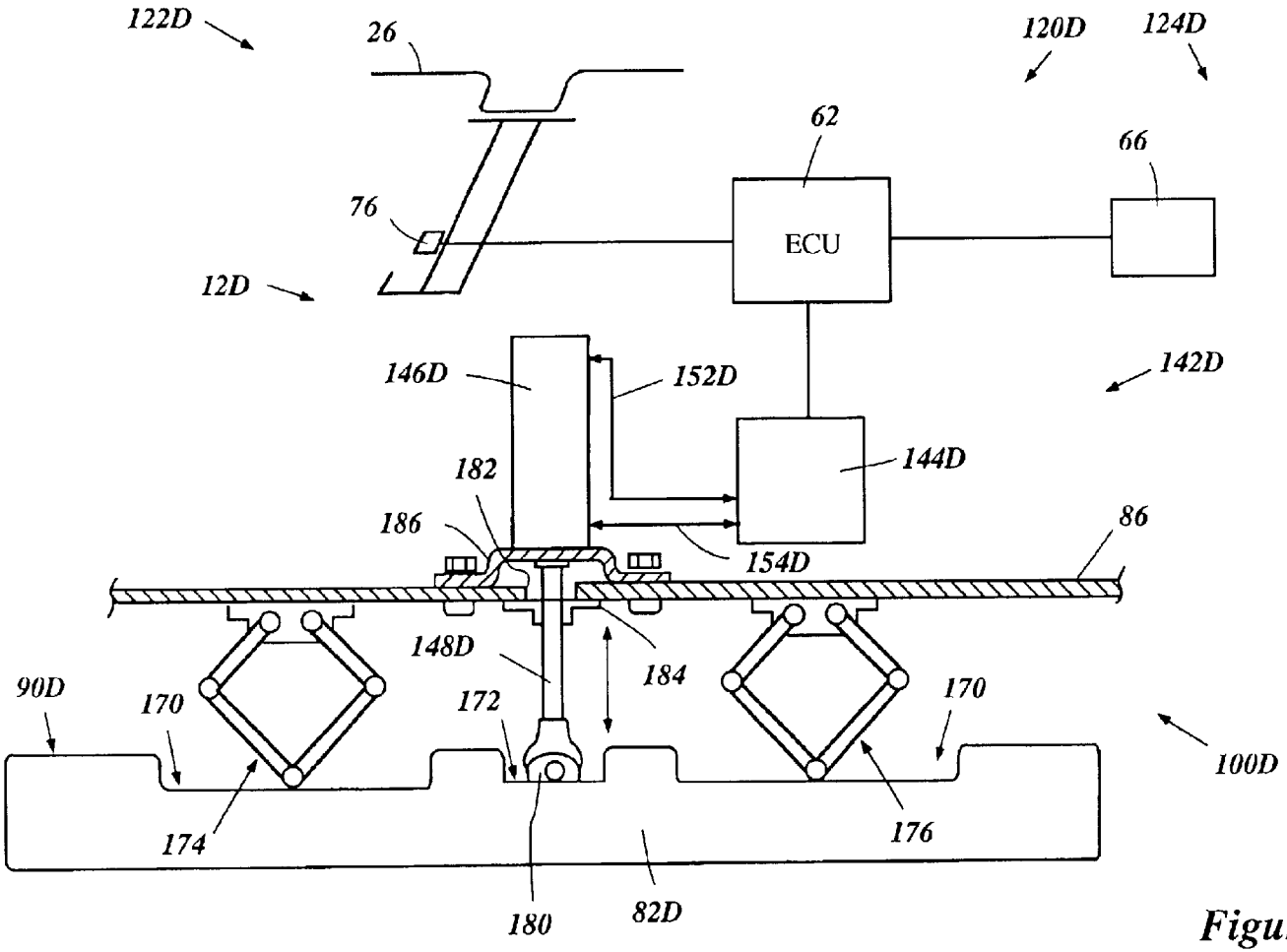
FIG. 13 is a schematic illustration of a modification of the sponson modules illustrated in FIG. 8–12.
Figure 14:
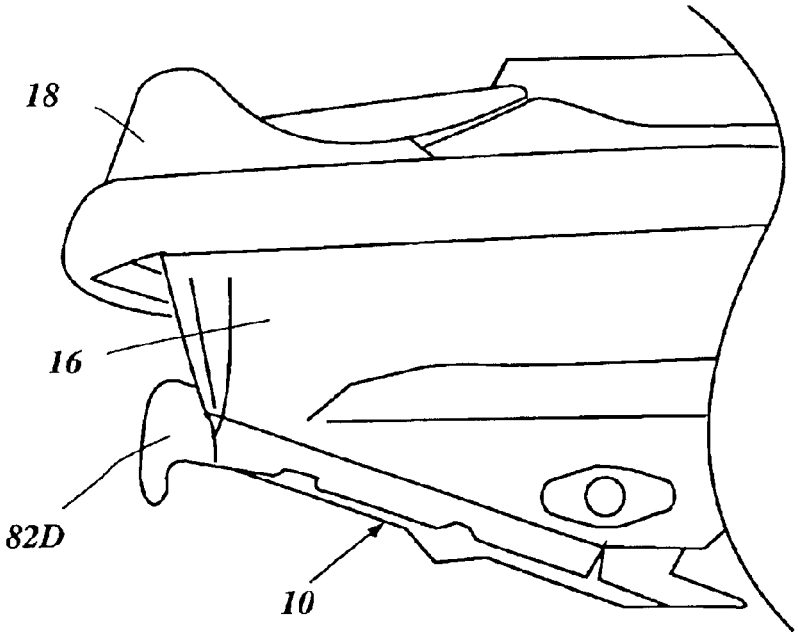
FIG. 14 is an enlarged rear elevational view of a modification of the watercraft illustrated in FIG. 4 and including the sponson module illustrated in FIG. 13, showing the sponson in a retracted position.

FIG. 13 illustrates another modification of the sponson module 12A and is identified generally by the reference numeral 12D. The components of the module 12D which are the same or similar to the components of any of the modules 12A–12C, are identified with the same reference numeral, except that a "D" has been added thereto.

The sponson 82D is similar to the sponsons 82, 82B, 82C. However, the sponson 82D preferably includes recesses 170, 172 on its inner surface 90D. Advantageously, the recesses 170, 172 are configured to accommodate components of the guide mechanism 100D.

In the illustrated embodiment, the recesses 170 at the forward and rearward portion of the inner surface 90D, are configured to accommodate portions of he guide mechanism 100D which define the fixed path along which the sponson 82D travels, discussed in greater detail below.

The guide mechanism 100D comprises front and rear multi-link assemblies 174, 176. Preferably, the multi-link assemblies 174, 176 comprise a plurality of pivoting members defining a scissor-type link mechanism. Preferably, the assemblies 174, 176 are configured to define a fixed path between retracted and deployed positions of the sponson 82D. For example, the assemblies 174, 176 can be constructed similarly to a scissor jack assembly, or a pantograph-type assembly.

The guide mechanism 100D, in the illustrated embodiment, is configured to guide the sponson 82D along a path that is generally perpendicular to the sidewall 86 of the hull 16. However, the guide mechanism 110D can be configured to guide the sponson 82D along a different path.

The actuator 142C is connected to the sponson 82D at a mounting boss 180. The mounting boss 180 preferably is disposed in the recess 172.

The output shaft 148D extends through an aperture 182 defined in the side 86 of the hull 16. A seal 184 defines a substantially water tight through hole fitting for the shaft 148D.

A mounting bracket 186 is also connected to the side wall 86. Additionally, the mounting bracket 186 supports the cylinder 146D relative to the side 86.

In operation, when the control module 120D receives a signal from the steering input module 122D that the operator intends to turn, and receives a signal from the engine load request input device 124D that the engine load request is below a predetermined threshold, the control module 120D causes the sponson 82D to move to a deployed position. For example, the ECU 62 can actuate the hydraulic supply 144 to supply fluid to the cylinder 146 through the supply line 152D. As such, the shaft 148D extends outwardly from the side wall 86 and thus urges the sponson 82D to a deployed position.

Figure 15:
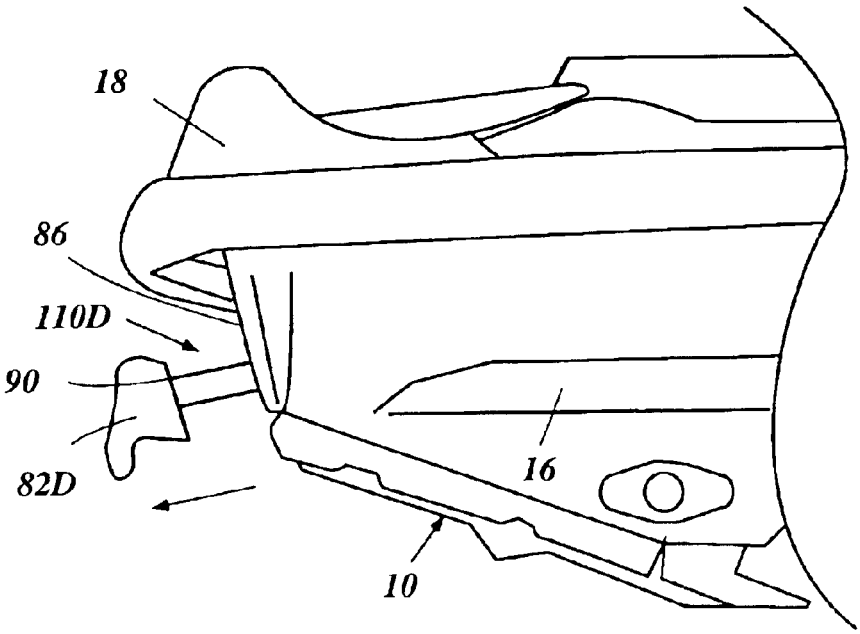
FIG. 15 is an enlarged rear elevational view of the watercraft illustrated in FIG. 14, with the sponson in a deployed position.

FIG. 15 illustrates the deployed position of the sponson 82D. In this position, the inner surface 90D of the sponson 82D is moved away from the side surface 86. Thus, the hydrodynamic resistance caused by the sponson 82D increases. Additionally, because the sponson 82D moves in a direction laterally away from the side wall 86, the moment arm of the torque imparted to the watercraft 10 is increased. This further enhances the torque imparted upon the watercraft 10, and thus enhances the steering effect provided by the module 100D.

Figure 16:
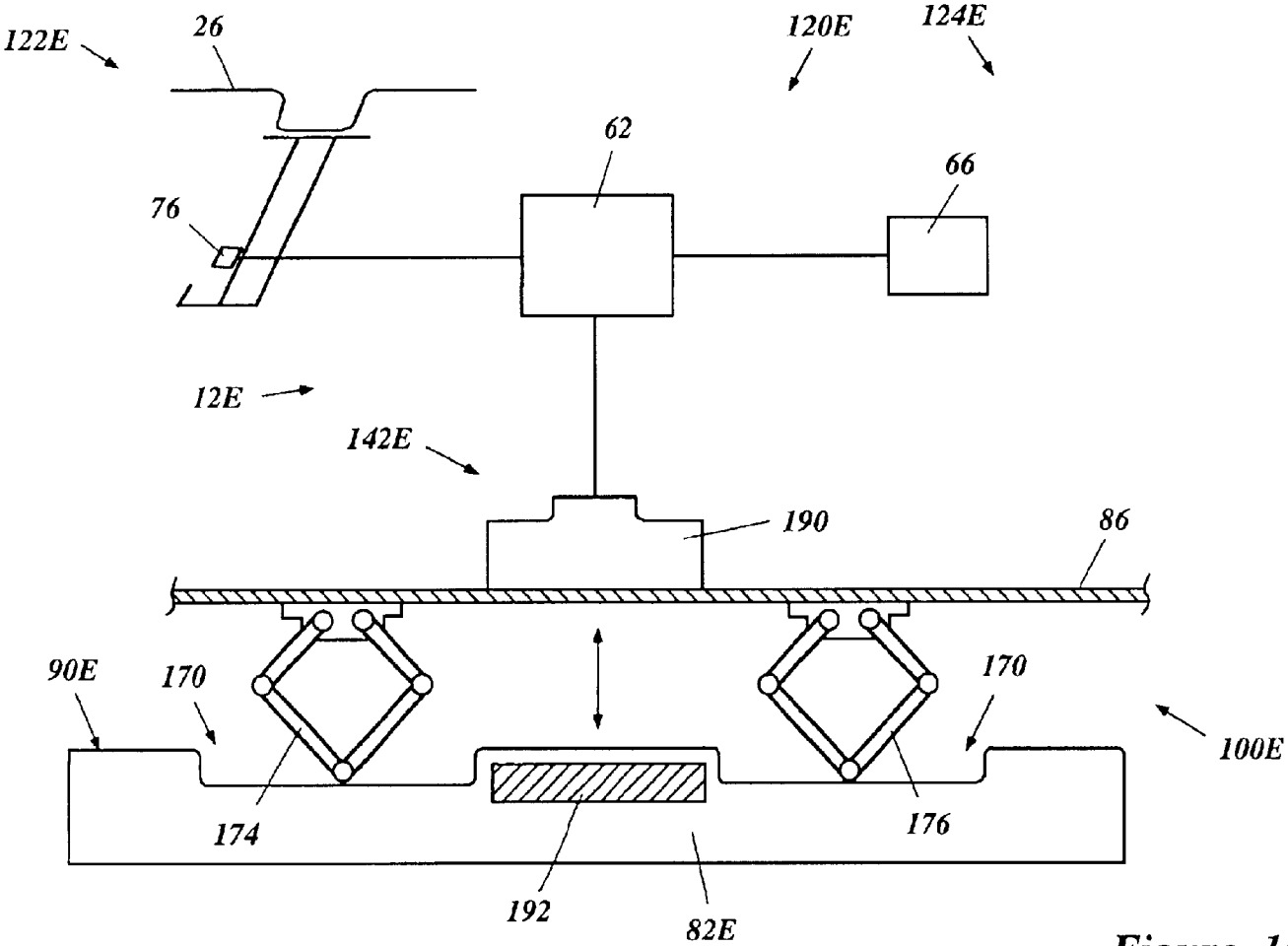
FIG. 16 is a schematic illustration of another modification of the sponson modules illustrated in FIGS. 8–16.

With reference to FIG. 16, a modification of the sponson module 12D is illustrated therein identified generally by the reference numeral 12E. Components of the module 12E, which are the same or similar to the module 12D, are identified with the same reference numeral. The construction and operation of the components with the same reference numeral can be identical or similar to the corresponding components in the module 12D, except as noted below.

The sponson 82E is similar to the sponson 82D illustrated in FIG. 13. However, the sponson 82E does not include the recess 172 of the sponson 82D.

The actuator 142E of the module 12E is a magnetic actuator. The actuator 142E is configured to move the sponson 82E between the retracted and deployed positions with a magnetic field.

Preferably, the actuator 142E includes an electromagnet 190 and a permanent magnet 192. In the illustrated embodiment, the electromagnet 190 is mounted to an inner side of the lateral side 86 of the hull 16. The permanent magnet 192 is mounted within the sponson 82E.

The electromagnet 190 is configured to be selectively operable so as to either attract the permanent magnet 192 or repel the permanent magnet 192. Thus, when the electromagnet 190 is energized to attract the permanent magnet 192, the sponson 82E moves toward and is fixed in place against the lateral side 86 of the hull 16. On the other hand, when the electromagnet 190 is energized to repel the permanent magnet 192, the sponson 82E moves toward the deployed position and is thus held there by the repulsion force between the electromagnet 190 and the permanent magnet 192.

This design provides a further advantage in that no through hole fitting is used for the actuator 142E. Thus, there are fewer water-tight seals needed for the module 12E.

Figure 17:
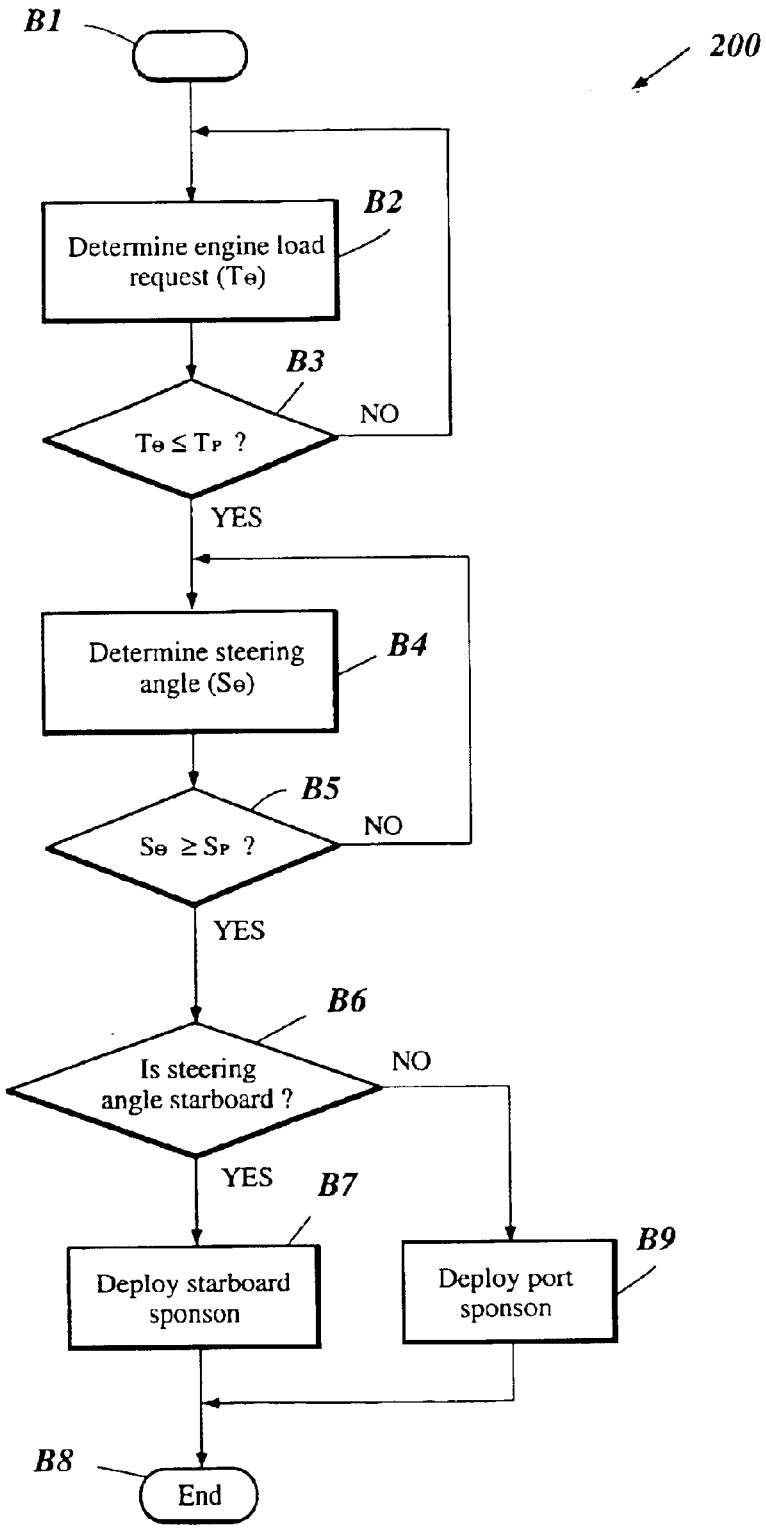
FIG. 17 is a flow chart illustrating a control routine that can be used with any of the sponson modules illustrated in FIGS. 8–16.

With reference to FIG. 17, a control routine for controlling the movement of the sponsons 82, 82B, 82C, 82D, 82E is illustrated therein and is identified generally by the reference numeral 200. At the block B1, the routine 200 begins. For example, the routine 200 can begin whenever the main power switch for the engine 56 is on. Optionally, the routine 200 can begin whenever the engine 56 is running. After the block B1, the routine 200 moves on to a block B2.

At the block B2, an engine load request To is determined. For example, the output of the throttle position sensor 66 can be sampled. In the watercraft 10, where the throttle valve is connected directly to a throttle lever with a direct mechanical connection, the engine load request is the same as the throttle position. After the block B2, the routine 200 moves on to a block B3.

At the block B3, it is determined whether the engine load request $T_\theta$ is less than or equal to a predetermined engine load request $T_P$. For example, the engine load request $T_\theta$ can be compared to a predetermined engine load request $T_P$. In a preferred embodiment, the predetermined load request $T_P$ is zero, which corresponds to a situation where the throttle lever mounted on the handlebar 26 is not depressed by an operator. Thus, the engine is either idling or stopped. However, other predetermined engine load requests can be used. If the engine load request $T_\theta$ is not less than or equal to the predetermined engine load request $T_P$, the routine 200 returns to block B2 and repeats. If, however, the engine load request $T_\theta$ is less than or equal to the predetermined engine load request $T_P$, the routine 200 moves on to a block B4.

At the block B4, a steering angle $S_\theta$is determined. For example, the output of the steering angle sensor 76 can be sampled. After the block B4, the routine 200 moves on to a block B5.

At the block B5, it is determined whether the steering angle $S_\theta$ is greater than or equal to a predetermined steering angle $S_P$. For example, the sampled steering angle $S_\theta$ can be compared to the predetermined steering angle $S_P$. If it is determined that the steering angle $S_\theta$ is not greater than or equal to the predetermined steering angle $S_P$, the routine 200 returns to block B4 and repeats. However, if the steering angle $S_\theta$ is greater than or equal to the predetermined steering angle $S_P$, the routine 200 moves on to a block B6.

At the block B6, it is determined whether the steering angle indicates a port or starboard direction. For example, as noted above, the steering angle sensor 76 can include a switch to determine whether the handlebar 26 is turned toward the port or starboard side. If it is determined the steering angle is toward the starboard side, the routine 200 moves to a block B7.

At the block B7, the corresponding sponson module 12A, 12B, 12C, 12D, 12E is controlled to deploy the starboard sponson. After the block B7, the routine moves on to block B8 and ends. Optionally, the routine 200 can return to the block B1 and begin again after the Block B8.

With reference to the block B6, if it is determined that the steering angle is not toward the starboard side, the routine 200 moves to a block B9.

At the block B9, the port side sponson is deployed. After the block B9, the routine 200 moves to the block B8 and ends, as noted above.

In the illustrated embodiment, the routine 200 is in the form of a computer program stored on a computer-readable medium within the ECU 62. The ECU 62 can include, as noted above, a general purpose processor and a memory for storing and running one or a plurality of computer programs, such as the routine 200. Optionally, the ECU 62 can include one or a plurality of dedicated processors and corresponding memories for storing and running one or a plurality of a computer programs, such as the routine 200. The routine 200, optionally, can be constructed as a hard wired system incorporated into the ECU.

Of course, the foregoing description is that of certain features, aspects and advantages of the present invention to which various changes and modifications may be made without departing from the spirit and scope of the present invention. A watercraft need not feature all objects of the present invention to use certain features, aspects and advantages of the present invention. The present invention, therefore, should only be defined by the appended claim.

What is claimed is:

1. A watercraft comprising a hull, an engine supported by the hull and having an output shaft, a propulsion device connected to the output shaft of the engine, a steering input device configured to be manually operable by an operator, a steering device configured to steer the watercraft in accordance with the position of the steering input device, first and second sponson modules connected to opposite sides of the hull, each sponson module comprising a sponson body having a first inner surface facing toward a side of the hull, a second lower surface extending from the inner surface away from the hull, and a third surface extending at an angle from the second surface and being spaced outwardly from the first inner surface, each sponson module also including a guide mechanism defining a fixed path of travel for each sponson body between a first retracted position and a second deployed position, a steering sensor configured to detect a position of the steering input device and to generate a position signal indicative of the position of the steering input device, an actuator for moving the sponsoring body between the first and second positions, and a controller configured to control the actuator based on the position signal from the steering sensor.

2. A watercraft according to claim 1, when the propulsion device comprises a jet pump, the steering device comprising a steering nozzle pivotally mounted at an outlet of the jet pump.

3. A watercraft comprising a hull, an engine supported by the hull, a power request input device positioned for operation by an operator of the watercraft, a steering input device mounted to the hull and configured for pivotal movement between port and starboard directions, port and starboard side sponsons, a controller configured to move the port and starboard sponsons relative to the hull between a retracted position and a deployed position, the controller being configured to deploy the port side sponson when the steering input device is turned toward the port side, and a power request sensor configured to detect a position of the power request input device and to generate a signal indicative of the position of the power request input device, wherein the power request input device is configured to move through first and second ranges of movement, the controller being configured to deploy the sponsons only if the request input device is within the first range of movement.

4. The watercraft according to claim 3, wherein the first range of movement corresponds to a first range of power output of the engine, the second range of movement corresponding to a second range of power output of the engine greater than the first range.

5. A watercraft comprising a hull, a power request device configured for operation by an operator of the watercraft, a steering input device configured for operation by an operator of the watercraft and for pivotal movement, at least a first sponson mounted for pivotal movement relative to the hull, a controller configured to control movement of the first sponson between retracted and deployed positions in response to pivotal movement of the steering input device and to determine if the power request device is suddenly released, wherein the controller is further configured to move the first sponson to the deployed position only when the watercraft is operating in a body of water at a planing speed, the power request device is suddenly released and at the same time, the steering input device is turned, the deployed position of the first sponson being configured such that the first sponson contacts the body of water sufficiently to cause the watercraft to turn at least ninety degrees before the watercraft coasts to a stop.

6. The watercraft according to claim 5 wherein the first sponson comprises a first surface juxtaposed to the hull of the watercraft and a second surface extending from the first surface away from the hull the watercraft, the first sponson being mounted to pivot between a retracted position and a deployed position such that in the deployed position, the second surface is skewed sufficiently relative to a surface of a body of water to generate yaw.

* * * * *

UNITED STATES PATENT AND TRADEMARK OFFICE

CERTIFICATE OF CORRECTION

PATENT NO. : 6,827,031 B2
APPLICATION NO. : 10/280199
DATED : December 7, 2004
INVENTOR(S) : Yusuke Aoyama It is certified that error appears in the above-identified patent and that said Letters Patent is hereby corrected as shown below:

At Column 16, Line 9-10, in Claim 1, after "device," please delete "first and second" and insert -- a --, therefor.

Signed and Sealed this

Seventh Day of July, 2009

JOHN DOLL
*Acting Director of the United States Patent and Trademark Office*